United States Patent [19]

Richter et al.

[11] Patent Number: 4,730,781

[45] Date of Patent: Mar. 15, 1988

[54] CONVEYOR FOR FEEDING STRIP MATERIAL IN A MACHINE FOR WORKING ON THE SAME

[76] Inventors: Gerhard Richter, Charlottenstrasse 6, D-5910 Kreuztal 5; Axel Barten, Im Gensterfeld 20, D-5900 Siegen-Sohlbach, both of Fed. Rep. of Germany

[21] Appl. No.: 941,612

[22] Filed: Dec. 12, 1986

[30] Foreign Application Priority Data

Jan. 9, 1986 [DE] Fed. Rep. of Germany ..... 3600372

[51] Int. Cl.[4] ..... B65H 19/12; B21C 47/16

[52] U.S. Cl. ..... 242/78.8; 242/79

[58] Field of Search ..... 242/78.8, 78.7, 78.6, 242/79, 58.6; 226/92

[56] References Cited

U.S. PATENT DOCUMENTS

| | | | |
|---|---|---|---|
| 1,872,045 | 8/1932 | Smitmans . | |
| 2,041,235 | 5/1936 | Darbaker . | |
| 2,262,118 | 11/1941 | Sieger . | |
| 3,010,672 | 11/1961 | Cecil, Jr. | 242/78.8 |
| 3,635,417 | 1/1972 | Kajiwara et al. | 242/78.8 |
| 4,214,467 | 7/1980 | Sankaran | 242/78.8 X |

FOREIGN PATENT DOCUMENTS

| | | | |
|---|---|---|---|
| 857787 | 12/1952 | Fed. Rep. of Germany . | |
| 1163760 | 2/1964 | Fed. Rep. of Germany . | |
| 1250395 | 9/1967 | Fed. Rep. of Germany | 242/78.8 |
| 2203705 | 8/1972 | Fed. Rep. of Germany . | |
| 2043396 | 5/1973 | Fed. Rep. of Germany . | |
| 2214034 | 10/1973 | Fed. Rep. of Germany . | |
| 1907083 | 12/1975 | Fed. Rep. of Germany . | |
| 2514164 | 10/1976 | Fed. Rep. of Germany . | |
| 2534622 | 2/1977 | Fed. Rep. of Germany . | |
| 3301816 | 8/1983 | Fed. Rep. of Germany . | |

*Primary Examiner*—John M. Jillions

*Attorney, Agent, or Firm*—Young & Thompson

[57] ABSTRACT

Primary components of the conveyor for introducing the thin strip material (2), wound into a coil (1), into the roll nip formed by the work rolls (4, 5) of a four-high rolling mill (3) are a coil cart (6) and a propelling device (7) with a clamping device (8) for seizing the strip feed end (9) of the rolling strip (2). Between a readying station (10) and an unwinding reel (11), a motor-driven coil cart (6) with a hoisting device (14) for lifting and lowering the coil (1) is movable in the strip traveling direction (a) on a track (12). In the readying station (10), backup and pinch rolls (15, 16), adjustable transversely to the strip traveling direction (a), are disposed in opposition on the two longitudinal sides of the coil cart route, for positioning the coil (1) and for threading the strip feed end (9) into a clamping device (8) attached to a transport device (7) with a drive motor, that can be propelled along a longitudinal side of the coil cart route. A clamping device (8) for seizing the strip feed end (9) at the coil (1) is attached to the propelling device (7); this clamping device can be pivoted about a pivot axis (19—19) extending transversely to the strip traveling direction (a) from a receiving position (I) in the range of action of an operator (27) by way of an intermediate position (II) over the coil (1) and a waiting position (III) into a position (IV) for transferring the strip feed end (9) to an introducing device (20) arranged upstream of the rolling mill (3), and vice versa.

6 Claims, 6 Drawing Figures

CONVEYOR FOR FEEDING STRIP MATERIAL IN A MACHINE FOR WORKING ON THE SAME

Figure 1A:
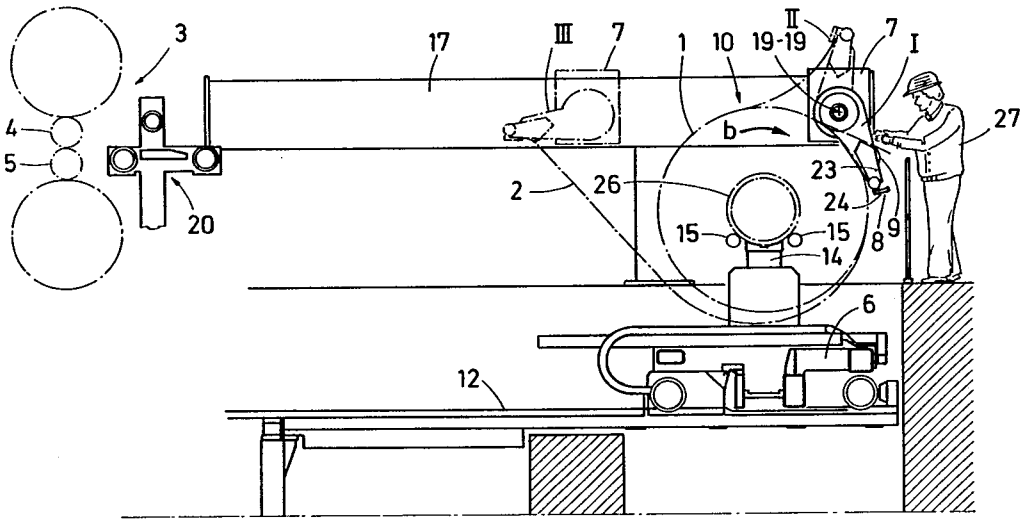

In the cold rolling of thin strip material having an initial thickness on the order of, for example, 300–80 μm to a final thickness of, for example, 6 μm, introduction of the strip feed end of the strip being unwound from a motor-driven strip reel into the roll nip of the work rolls of a rolling mill at the beginning of the rolling operation presents considerable difficulties since, the roll nip is accessible only with difficulties and there is the danger that the thin strip material will warp in the zone of the strip feed point and may jam in such a case.

Numerous strip feeding devices for thin-gage strip rolling mills have been known, operating with mechanical, pneumatic or electromagnetic devices and with combined devices of the aforementioned designs.

Strip feeding devices wherein air-cushion conveyors are utilized have been disclosed, for example, in German Pat. Nos. 2,514,164 and 1,907,183, as well as DOS No. 2,938,022. Such air-cushion conveyors for introducing thin-gage strip into strip rolling mills have proven themselves under practical conditions.

Furthermore, according to a statement in German Pat. No. 2,514,164, linear motors consisting of a stator generator are utilized as conveying means for feeding foil strip into rolling mills. The foil strip is conducted through an air gap and is advanced as the motor armature by the thus-occurring magnetic forces. These linear motors exhibit the drawback that the attractive forces in the direction of the stator generator are very great as compared with the magnetic forces that advance the foil strip. Another disadvantage resides in that the air gap between the stator generator and the foil strip must be designed to be large in order to avoid damage to the strip. This feature contributes toward making the conveyor expensive. It is furthermore disadvantageous that the degree of efficiency of the linear motor depends on the electric conductivity of the strip material. Besides the high cost of manufacturing the linear motor, there is the further deficiency that expensive protective devices must be provided in order to prevent penetration of rolling oil into the motor; this oil will render the motor inoperative.

The aforedescribed strip feeding devices all have the disadvantage that transporting of the strip feed end from the coil seated on the drum of the unwinding reel to the conveyor must be performed manually in a cumbersome way. Transporting the feed end of the strip by hand is possible only under great difficulties with considerable consumption of time in cases where, for increasing productivity of the rolling mills by shortening downtimes, strip coils are used having a diameter of up to 2 m and a width of above 2 m.

DAS No. 1,163,760 discloses a strip feeding device for rolling mills wherein the strip feed end, held on the coil by means of a pressure roller attached to a pivotable outrigger arm, is grasped by magnets freely movable on slides in the longitudinal direction of the outrigger arm. After the unwinding reel has been turned on, the magnets holding the feed end of the strip are transported with the slides by the propulsion of the rotating coil to a set of pinch rolls seizing the strip feed end and introducing same into a rolling mill. This strip introduction device is not suited for thin-gage strip rolling mills, since on account of the lack of inherent rigidity of the strip the slides with the magnets holding the strip feed end cannot be advanced through the propulsion of the revolving coil, and the magnets, when rolling predominantly nonmagnetic strip material of aluminum, copper, brass, or the like, cannot exert their seizing function for the strip feed end.

Finally, a strip introduction device for thin-gage strip rolling mills has been known from DOS No. 2,534,622 which exhibits a transporting device capable of traveling in the zone of the feed point for the strip above the strip feeding plane on tracks in the strip traveling direction; suction cups arranged over the strip width, or a suction belt, are suspended on this transporting device and seize the strip feed end lying on the coil and convey same to an air-cushion conveyor arranged in front of the first rolling mill stand. This strip feeding installation is unsuitable for thin strip material since the vacuum conveyor causes formation of creases in the strip.

The invention is based on the object of developing a conveyor making it possible to perform a most extensively mechanical introduction of thin strip material up to foil thickness into thin-gage strip rolling mills.

The invention is distinguished in that it solves the posed problem in a structurally simple and advantageous fashion.

Figure 1B:
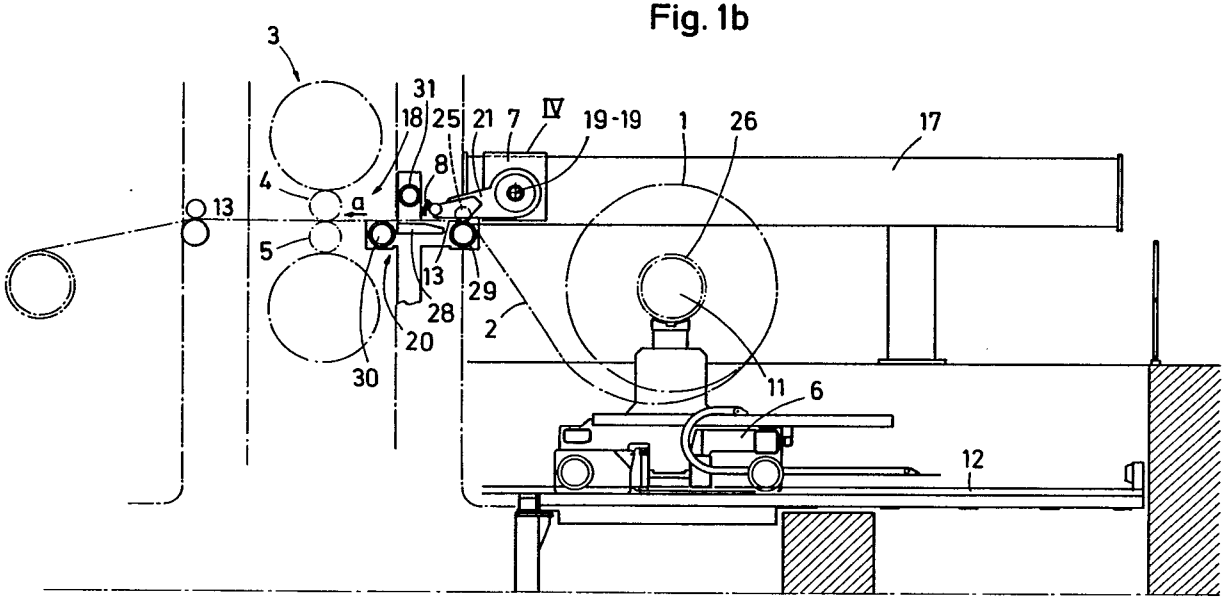
Figure 2:
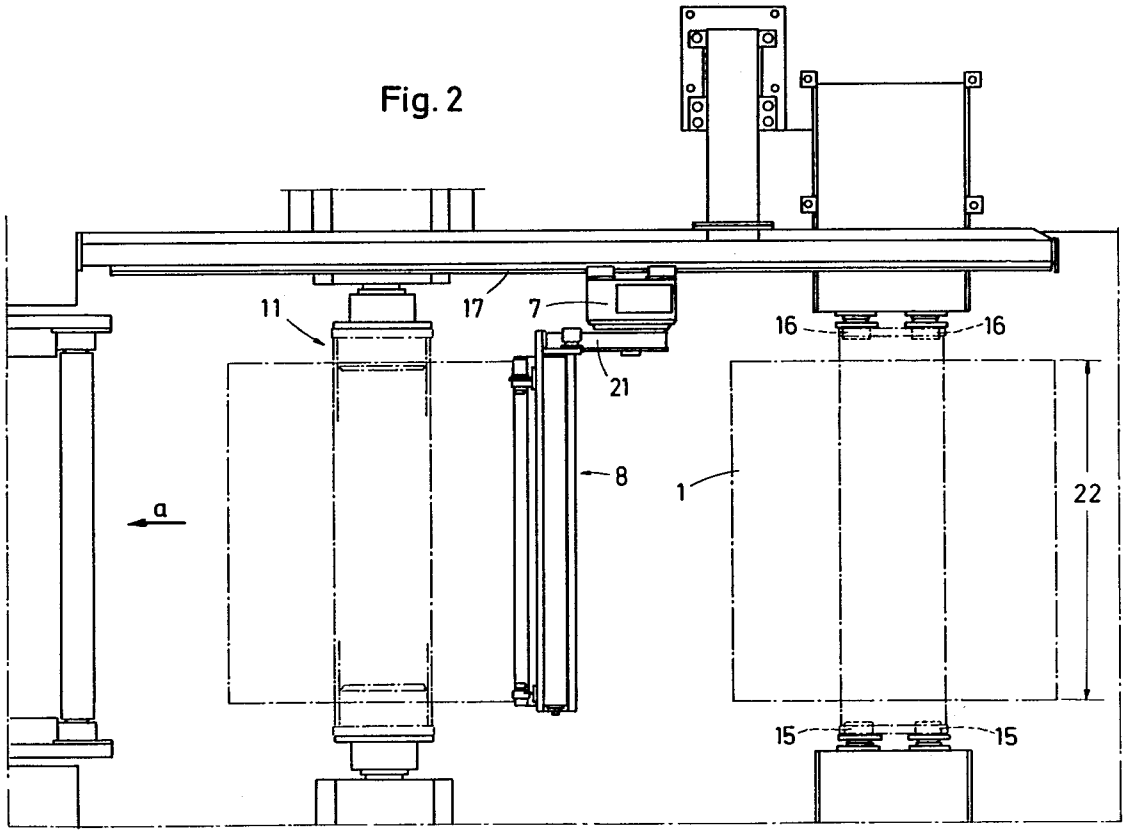
Figure 3:
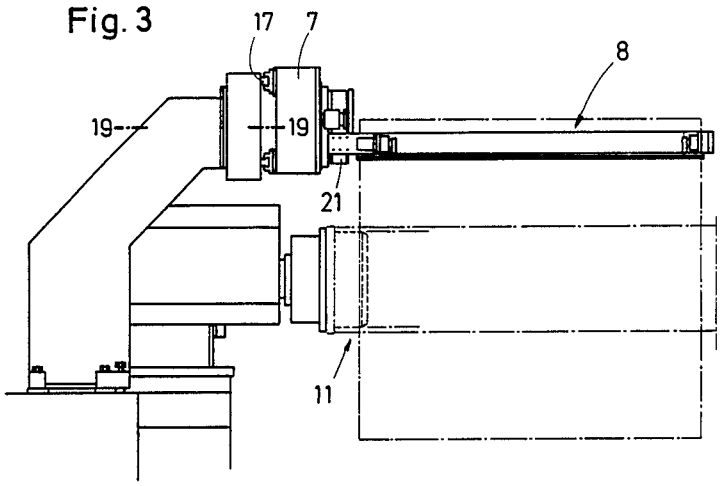
Figure 5:
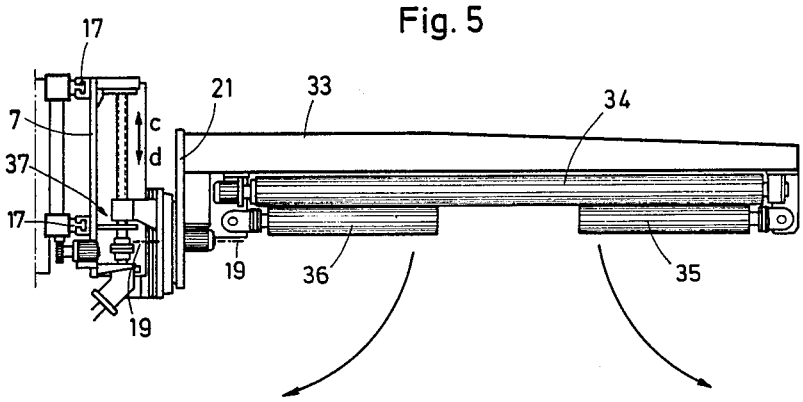
Figure 4:
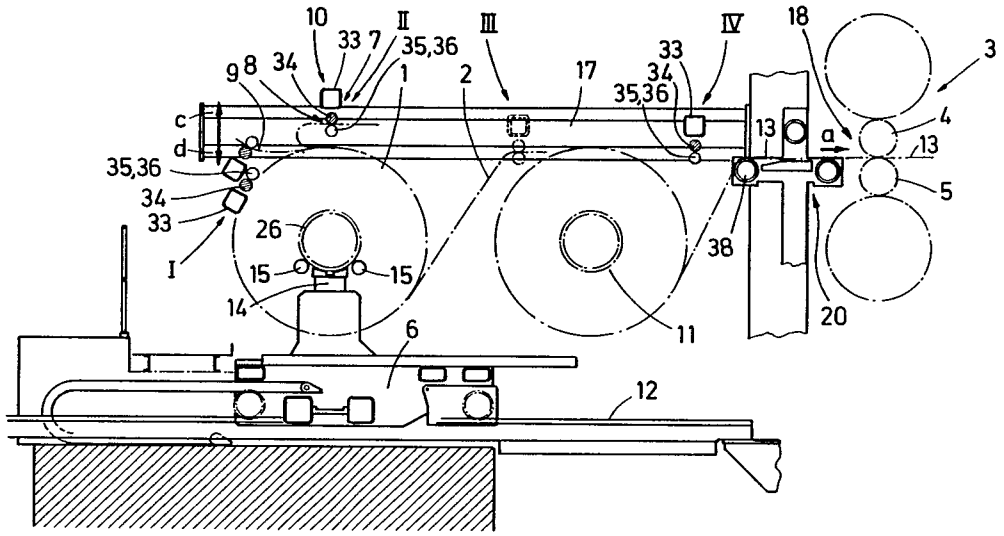

The invention will be described in detail below with reference to two embodiments illustrated in the drawings wherein identical or similar components are identified by identical reference symbols. The drawings show, in respectively schematic views:

FIGS. 1*a* and 1*b* show the conveyor in a lateral view with the various operating positions of the clamping device for the strip feed end, in a first embodiment, FIG. 2 shows a top view of the conveyor according to FIG. 1, FIG. 3 shows a front view of the propelling means of the conveyor with the strip clamping device according to FIGS. 1*a* and 1*b*, FIG. 4 shows a lateral view, corresponding to FIGS. 1*a* and 1*b*, of the conveyor with a second embodiment of the strip clamping device, and FIG. 5 is a front view of the propelling means of the conveyor with the strip clamping device according to FIG. 4.

Primary components of the conveyor illustrated in FIGS. 1–3 for introducing the thin strip material (2), coiled into a coil (1) having a diameter of up to 2 m and a width of more than 2 m, into the roll nip formed by the work rolls (4, 5) in the first rolling mill stand of a thin-gage strip four-high stand (3) are a coil cart (6) and a propelling device (7) with a clamping device (8) for seizing the strip feed end (9) of the rolling strip (2).

The motor-driven coil cart (6) can travel in the strip moving direction a between a readying station (10) and an unwinding station (11) in the zone of the strip feed on a track (12) underneath the strip traveling plane (13—13). The coil cart (6) is equipped with a hoisting device (14) for the lifting and lowering of the coil (1) perpendicularly to the strip traveling plane (13—13).

In the readying station (10), on the two longitudinal sides of the route of the coil cart (6), two backup and pinch roller pairs (15, 16) adjustable transversely to the strip travel direction (a) are arranged in mutual opposition for positioning the coil (1) and for threading the strip feed end (9) into the clamping device (8) attached to the propelling device (7), which clamping device will be described below.

The propelling device (7), equipped with a drive motor, can travel along a track (17) arranged on a longitudinal side of the route of the coil cart (6), preferably on the driving side of the rolling mill (3), above the coil cart route, between the readying station (10) and the strip feed (18) into the rolling mill (3).

The clamping device (8) attached to the propelling device (7) for seizing the strip feed end (9) can be swung by means of a motor about a swivel axis (19—19) extending transversely to the strip travel direction (a) from a receiving position (I) in the range of action of an operator (27) standing at the readying station (10) ,through an intermediate position (II) over the coil (1) and a waiting position (III) into a position (IV) for transferring the strip feed end (9) to an introduction means (20) provided in front of the four-high rolling mill (3), and vice versa.

The clamping device (8) for the rolling strip (2) exhibits two clamping bars (23, 24) arranged at the free end of a swivel arm (21) above the strip travel plane (13—13) transversely to the strip travel direction (a) and extending transversely over the strip width (22), one of these bars (23) being stationary and the other (24) being pivotable, by means of a drive mechanism, toward the fixed clamping bar (23) and away therefrom. Furthermore, a pinch roll (25) is arranged on the swivel arm (21).

The conveyor operates as follows: During rolling of the strip material (2), unwound from a coil (1) seated on the drum of the unwinding reel (11), the next coil (1) is prepared in the readying station (10). For this purpose, the coil (1) that had been transported by means of a crane or the like onto the coil cart (6), parked in the readying station (10), is lifted by the hoisting device (14) of the coil cart (6) to such a height that the backup and pinch rolls (15, 16), displaced by a certain extent transversely to the strip travel direction (a) toward the strip center, extend underneath the ends of the coil core (26). The propelling device (7) with the clamping means (8) is moved back into the readying station (10) to such a degree that the clamping means (8) can be swung into the receiving position (I) which—as seen in the strip travel direction (a)—is in front of the coil (1) and is in the range of action of an operator (27). After opening the clamping bars (23, 24) of the clamping device (8), the coil (1) is turned gradually in the rotating direction (b) by means of the backup and pinch rolls (15, 16) to such an extent that the strip feed end (9), if necessary with the aid of the operator (27),slides off the coil (1) by way of the pinch roll (25) and the fixed clamping bar (23). By swinging the clamping bar (24) with the aid of a motor against the clamping bar (23), the clamping device (8) is closed and the strip feed end (9) is clamped between the bars (23, 24). Subsequently, the clamping device (8) is swung by means of the swivel arm (21) upwardly into the intermediate position (II) over the coil (1), the strip feed end (9) being lifted off the coil (1) in the upward direction. At this point, the propelling device (7) is advanced from the readying station (10) into a position between the latter and the unwinding reel (11), the strip feed end (9) being lifted over the coil (1) in the readying station (10). Thereafter the clamping device (8) is swung downwards into the waiting position (III) wherein the swivel arm (21) points with the clamping bars (23, 24) and the clamped-in-place strip feed end (9) in the strip travel direction (a), and the strip feed end (9) is at the level of the strip travel plane (13—13). During the advancing or after the advancing of the clamping device (8), the coil (1) is taken up by the hoisting mechanism (14) of the coil cart (6), and the backup and pinch rolls (15, 16) in the readying station (10) are retracted into the rest position. As soon as the coil (1) present on the unwinding reel (11) has been unwound, the rolling mill (3) is brought to a standstill, the reeling heads of the unwinding reel (11) are moved out of the coil core (26), and the core is removed from the reel (11). At this point, the coil cart (6) with the coil (1) and the propelling device (7) with the clamping means (8) and with the strip feed end (9) clamped in place thereby are advanced in synchronism in the strip travel direction (a) to such an extent that the coil cart (6) is at the level of the unwinding reel (11) so that the reeling heads can be inserted in the coil core (26) and the propelling device (7) has reached the position in the zone of the strip feed point (18) wherein the clamping device (8) assumes the transfer position (IV) directly above the introducing means (20) which latter consists of a pneumatic feed table that can be lifted and lowered perpendicularly to the strip traveling plane (13—13) with an air-cushion conveyor (28), as well as of two guide rollers (29, 30) and a tensioning roller (31). In the transfer position (IV), the pinch roll (25) of the clamping device (8) rests on the front guide roller (29) and is urged, by the weight of the clamping device (8) and optionally additionally by the drive mechanism of the swivel arm (21), against the rolling strip (2) and the guide roller (29). After the strip feed end (9) has been released by opening the clamping bars (23, 24), the drive motor of the pinch roll (25) of the clamping device (8), and the air-cushion conveyor (28) which, if desired, can be followed by still another air-cushion conveyor directly upstream of the roll nip, are turned on so that the strip feed end (9) is introduced through the roller pair (25, 29) and the air-cushion conveyor conveyors (28) into the roll nip of the rolling mill (3). During this process, the unwinding reel is unwound in synchronism. Finally, the clamping device (8) is swung upwards into the intermediate position (II) and returned, together with the propelling device (7), into the readying station (10) wherein a new coil (1) is prepared.

The aforedescribed conveyor, which moves into the immediate vicinity of the introducing means arranged in front of the roll nip, is preferably utilized for introduction of very thin strip material having a thickness of 80 μm up to foil thickness, in thin-gage strip rolling mills.

In a modification of the above-described conveyor, the propelling device can be additionally equipped with a hoisting means for the vertical lifting and lowering of the clamping device.

The conveyor according to FIGS. 4 and 5 differs from the apparatus described hereinabove by a different construction of the clamping device.

The clamping device (8) exhibits a support (33), arranged at the free end of a swivel arm (21) transversely to the strip travel direction (a), for a pinch and conveying roller (34) extending over the strip width (22) and drivable by a motor, as well as two counter pinch rollers (35, 36) arranged coaxially and in parallel to the clamping roller (34); these counter pinch rollers are fashioned as pivoting rollers and are pivotably attached to the support (33) in the zone of the two ends of clamping roller (34). The swivel arm (21) with the clamping device (8) can be lifted and lowered perpendicularly to the strip traveling plane (13—13) by means of a hoisting device (37) installed in the propelling unit (7).

The mode of operation of the conveyor according to FIGS. 4 and 5 is similar to the mode of operation of the installation according to FIGS. 1–3.

In the receiving position (I) of the clamping device (8), clamping the strip feed end (9) in place, pertaining to the conveyor of FIGS. 4 and 5, the clamping and conveying roller (34) is located beneath the two counter pinch rollers (35, 36). Subsequently, the clamping device (8) is lifted by means of the hoisting unit (37) in the direction (c) perpendicularly to the strip traveling plane (13—13) and swung by means of the swivel arm (21) into the intermediate position (II) wherein the pinch and transporting roller (34) is arranged above the counter pinch rollers (35, 36). Thereafter, the propelling means (7) with the clamping device (8) is advanced, and the clamping device is lowered, by means of the hoisting device (37), in the direction (d) perpendicularly to the strip traveling plane (13—13) into the waiting position (III). For introducing the strip feed end (9) into the rolling mill (3), the coil cart (6) with the coil (1) and the propelling unit (7) with the clamping device (8) are advanced in synchronism for such a distance that the coil (1) reaches the unwinding reel (11) and the clamping device (8) reaches the transfer position (IV). As soon as the unwinding reel (11) is ready for operation, the pinch and conveyor roller (34) is turned on so that the strip feed end (9) is conveyed via the guide roller (38) and a feed means (20) with a pneumatic feeding table into the roll nip of the rolling mill (3).

The conveyor according to FIGS. 4 and 5 is preferably employed for the introduction of thin strip material having a thickness in the range from 300 to 80 $\mu$m in thin-gage strip rolling mills.

We claim:

1. Apparatus for feeding thin gauge strip material from the underside of a coil of the same into a rolling mill for movement through the rolling mill in a strip feed direction, comprising a motor-driven coil cart, means supporting the cart for movement toward and away from the rolling mill in the strip feed direction between a readying station remote from the mill and an unwinding station adjacent the mill, a clamping device for seizing an end of the strip material in said readying station, means mounting said clamping device for vertical swinging movement about a horizontal axis to invert the seized end of the strip material, and means mounting said clamping device for movement along said strip feed direction independently of said cart to move said seized end toward said mill.

2. Apparatus as claimed in claim 1, and a hoisting device for lifting and lowering the coil on the cart.

3. Apparatus as claimed in claim 1, and back-up and pinch rolls disposed in said readying station on opposite sides of the cart for positioning the coil to assist in threading said end of said strip material into said clamping device.

4. Apparatus as claimed in claim 1, said clamping device having two clamping bars disposed at the free end of a swivel arm and extending transversely to said strip feed direction, one of said bars being fixed and the other being movable toward and away from the fixed bar to clamp said strip material between said bars.

5. Apparatus as claimed in claim 4, and means for vertically raising and lowering said axis of rotation of said clamping device.

6. Apparatus as claimed in claim 1, in which said clamping device comprises a support attached to a free end of a swivel arm extending transversely to said strip feed direction, said support supporting a transport roller extending across said strip material and two coaxial counter-clamping rollers parallel to said clamping and transport roller, said coaxial rollers comprising pivoting rollers pivotally mounted on said support adjacent opposite ends of said clamping roller, and means mounting said swivel arm for vertical movement.

* * * * *